US006584627B1

(12) United States Patent
Yang

(10) Patent No.: US 6,584,627 B1
(45) Date of Patent: Jul. 1, 2003

(54) WEBBED FRAME FOR FURNITURE

(76) Inventor: Chen-Yen Yang, No. 11, Lane 365, Shang-An Rd., Changhua City, Changhua Hsien (TW)

( * ) Notice: Subject to any disclaimer, the term of this patent is extended or adjusted under 35 U.S.C. 154(b) by 0 days.

(21) Appl. No.: 10/050,502

(22) Filed: Jan. 16, 2002

(51) Int. Cl.[7] ..... A47C 19/00

(52) U.S. Cl. ..... 5/191; 5/174; 5/211; 5/213; 5/220; 5/226

(58) Field of Search ..... 5/191, 190, 211, 5/213, 220, 221, 222, 223, 226

(56) References Cited

U.S. PATENT DOCUMENTS 1,242,960 A * 10/1917 McIntosh ..... 51/191
2,615,178 A * 10/1952 Karg ..... 5/220
3,289,220 A * 12/1966 Grimshaw ..... 05/220
3,346,891 A * 10/1967 Cundiff ..... 5/191
3,968,528 A * 7/1976 Poerink ..... 5/211

* cited by examiner

*Primary Examiner*—Alexander Grosz
(74) *Attorney, Agent, or Firm*—Trop, Pruner & Hu, P.C.

(57) ABSTRACT

A webbed frame includes a plurality of first and second straps mounted on a frame body to form a net. Each of the first and second straps has two opposite end sections trained on the frame body. A plurality of spaced apart retainers are fixed on the frame body. Each of several adjuster units includes a connector mounted slidably on a respective one of the retainers and connected to a respective one of the first and second straps. An adjusting bolt threadedly engages and extends through the connector, and has an abutting end that abuts against the frame body such that rotation of the adjusting bolt results in concurrent movement of the connector and the respective one of the first and second straps so as to adjust tension of the net on the frame body.

5 Claims, 11 Drawing Sheets

WEBBED FRAME FOR FURNITURE

BACKGROUND OF THE INVENTION

1. Field of the Invention

The present invention relates to a frame, more particularly to a webbed frame for use in a piece of furniture.

2. Description of the Related Art

Referring to FIGS. 1, 2A and 2B, a conventional webbed frame for use in a piece of furniture, such as a bed, is shown to include a rectangular frame body 13, a plurality of first and second straps 12, a plurality of hooks 123,16, and a plurality of strap adjuster units.

As illustrated, the first and second straps 12 are mounted on the frame body 13, and extend in criss-cross manner to form a net 121 above the frame body 13. Each of the first and second straps 12 has a first strap section 122 fastened to the frame body 13 via the hook 123 and a screw 133, and a second strap section 124 fastened to the frame body 13 via the hook 16 and one of the strap adjuster units. Each of the strap adjuster units includes a threaded bolt 153 and a mounting plate 15 that is secured on the hook 16, which is detachably mounted on the frame body 13, and that has a lower portion 150 holding the second strap section 124 of each of the straps 12 which passes over a rear side of the mounting plate 15. The threaded bolt 153 threadedly extends through the mounting plate 15, and has an abutting end that abuts against the second strap section 124 of the strap 12 in such a manner that rotation of the bolt 153 relative to the mounting plate 15 results in pressing or non-pressing action on the second strap section 124 of the first and second straps 12 so as to change tension of the net 121 on the frame body 13.

The conventional webbed frame is disadvantageous in that the mounting plate 15 tends to disconnect from the hook 16 due to a pulling force acting on the lower portion 150 via the second strap section 124 when the first or second strap 12 is pressed by the bolt 153.

SUMMARY OF THE INVENTION

Therefore, the object of the present invention is to provide a webbed frame for furniture, the webbed frame having a specific structure such that the aforesaid disadvantage encountered during use of the conventional webbed frame can be avoided.

Accordingly, a webbed frame of the present invention is adapted to be used in a piece of furniture, and includes a frame body defining a frame space, a plurality of adjuster units, and a plurality of first and second straps which are mounted on the frame body and which extend in criss-cross manner to form a net that covers the frame space. Each of the first and second straps has two opposite end sections that are trained on and turned around the frame body and that have terminating ends disposed underneath the net. A plurality of spaced apart retainers are fixed on and along the length of the frame body, and extend into the frame space. Each of the adjuster units includes a connector and an adjusting bolt. The connector is mounted slidably on a respective one of the retainers and is connected to a respective one of the terminating ends of the first and second straps so that movement of the connector on the respective one of the retainers results in concurrent movement of the respective one of the terminating ends so as to tighten or loosen the first and second straps on the frame body and so as to adjust tension of the net. The adjusting bolt threadedly engages and extends through the connector, and has an abutting end that abuts against the frame body so that rotation of the adjusting bolt results in concurrent movement of the connector and the respective one of the terminating ends so as to permit adjustment of the tension of the net on the frame body.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
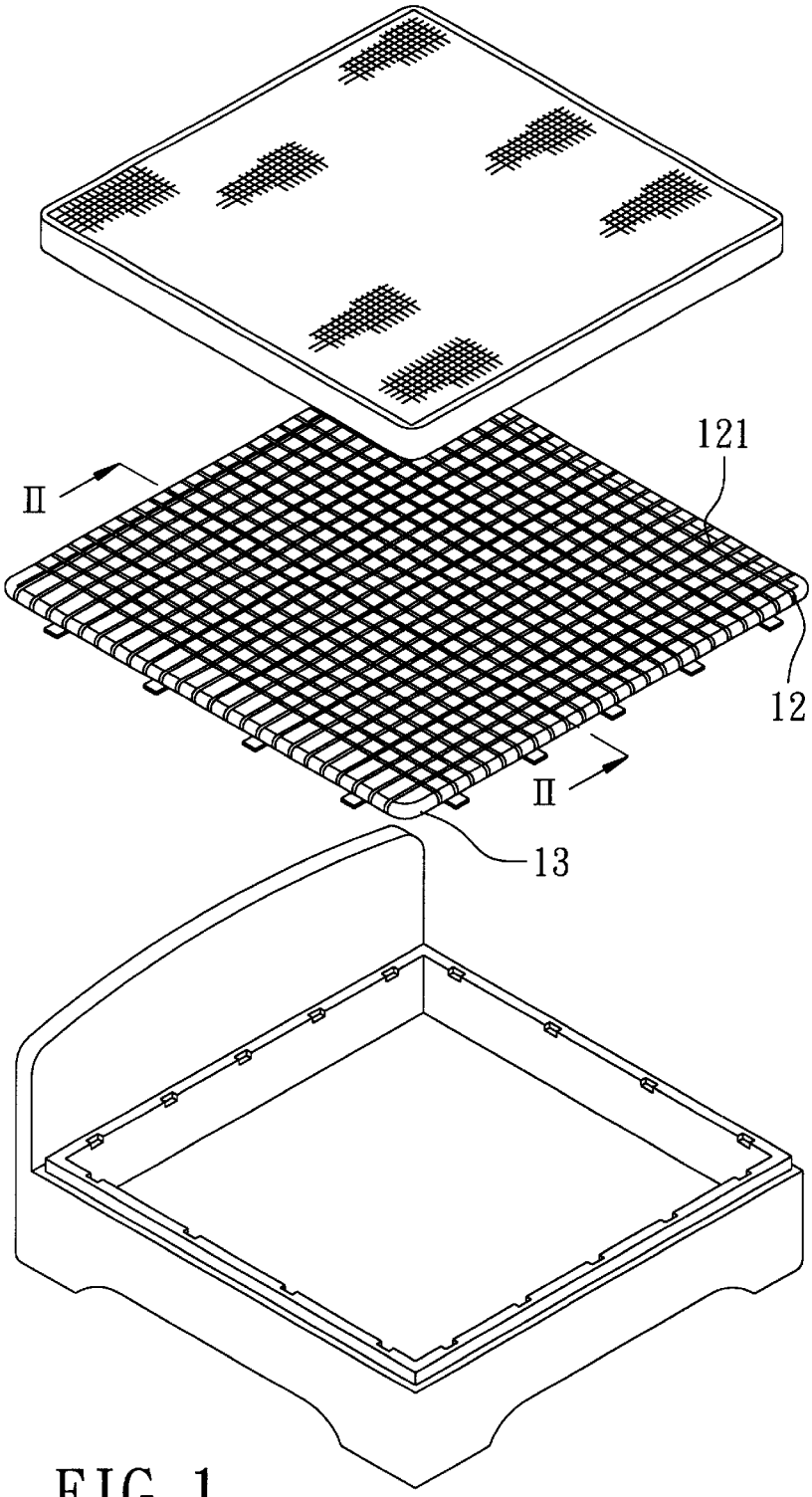
FIG. 1 PRIOR ART
FIG. 1 is a perspective view of a conventional webbed frame use in a piece of furniture.
Figure 2A:
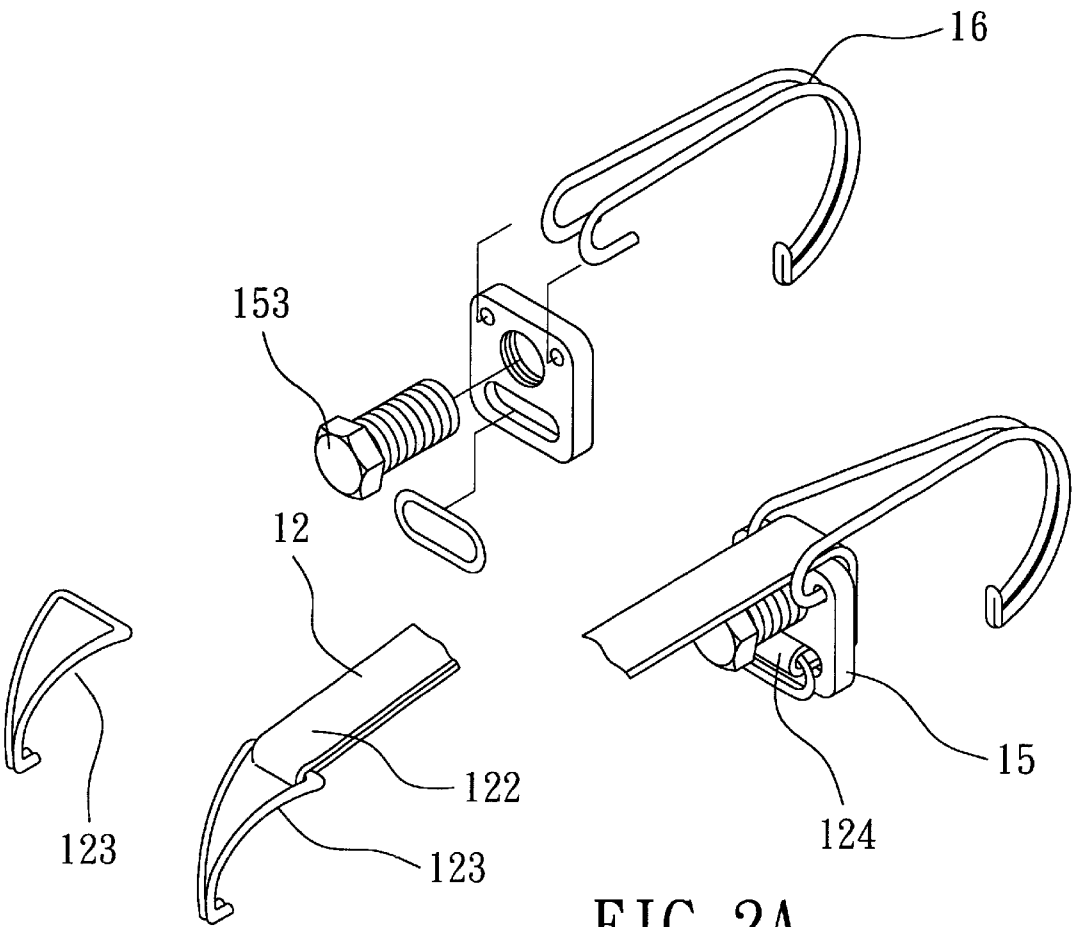
FIG. 2A PRIOR ART
FIGS. 2A and 2B are respectively fragmentary exploded perspective and schematic sectional views of the conventional webbed frame, illustrating how a plurality of straps are mounted on a frame body.
Figure 2B:
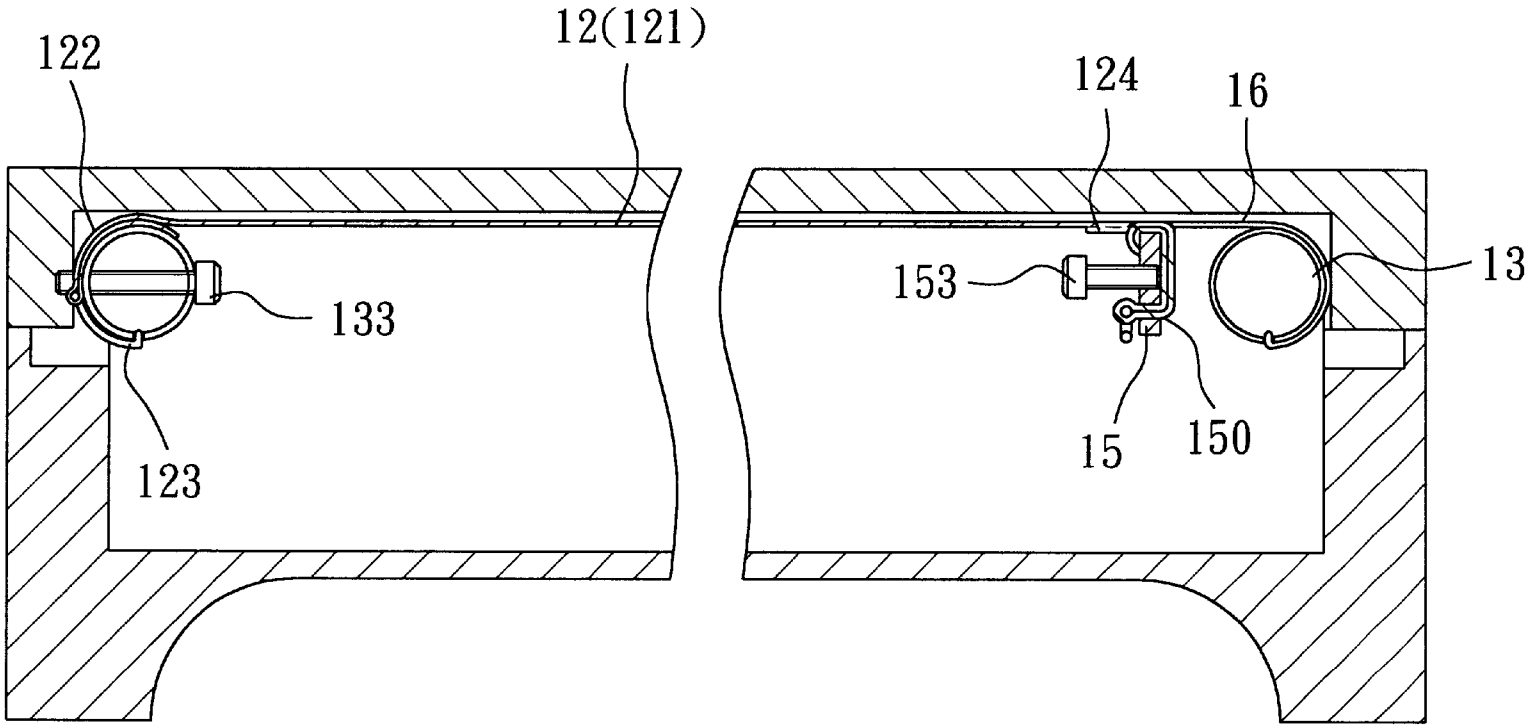
FIG. 2B PRIOR ART

Before the present invention is described in greater detail with reference to the following preferred embodiments, it should be noted that same reference numerals have been used to denote similar elements throughout the specification.

Figure 3:
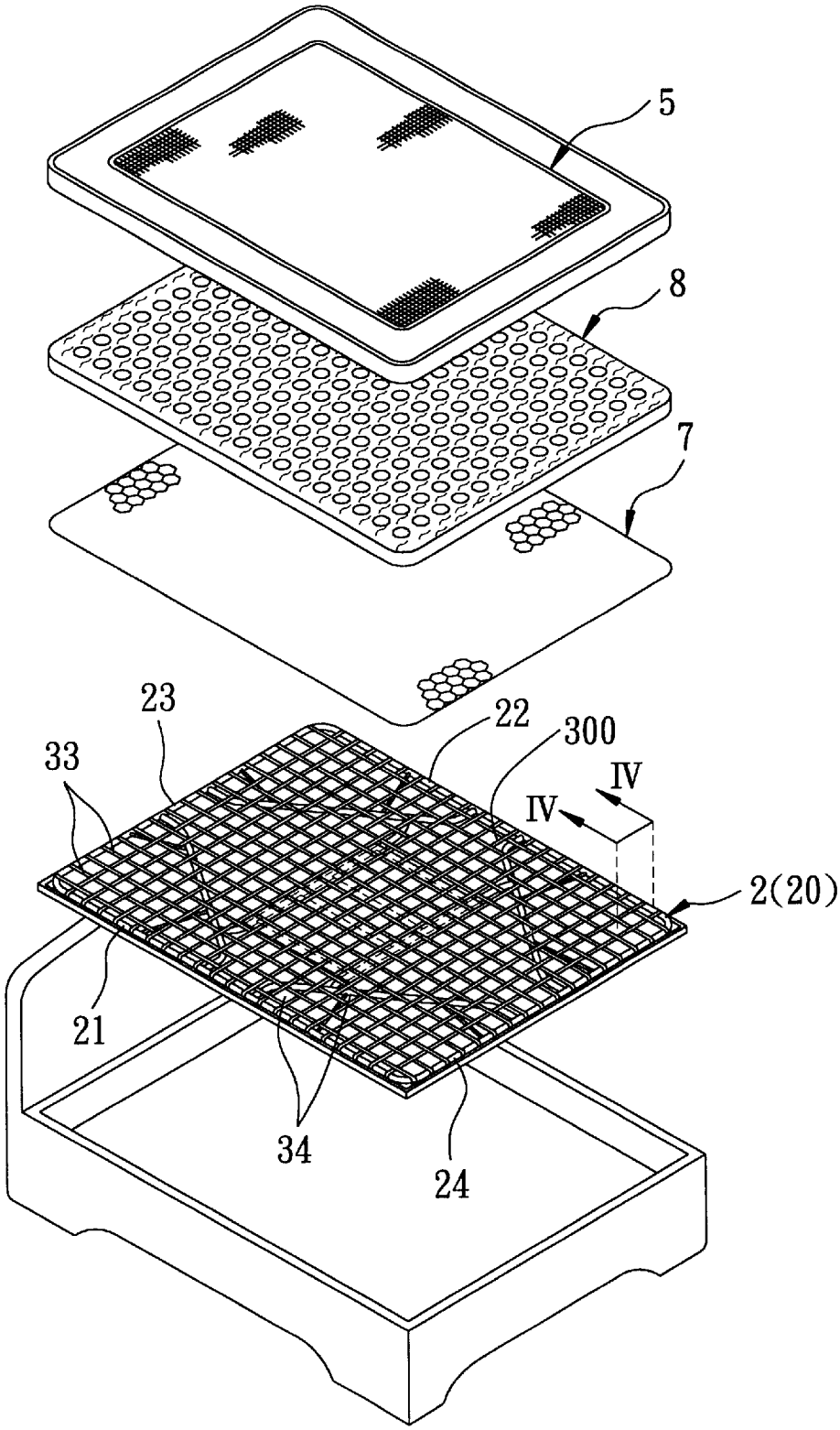
FIG. 3 is an exploded perspective view showing a preferred embodiment of a webbed frame according to the present invention for use in a bed.
Figure 4:
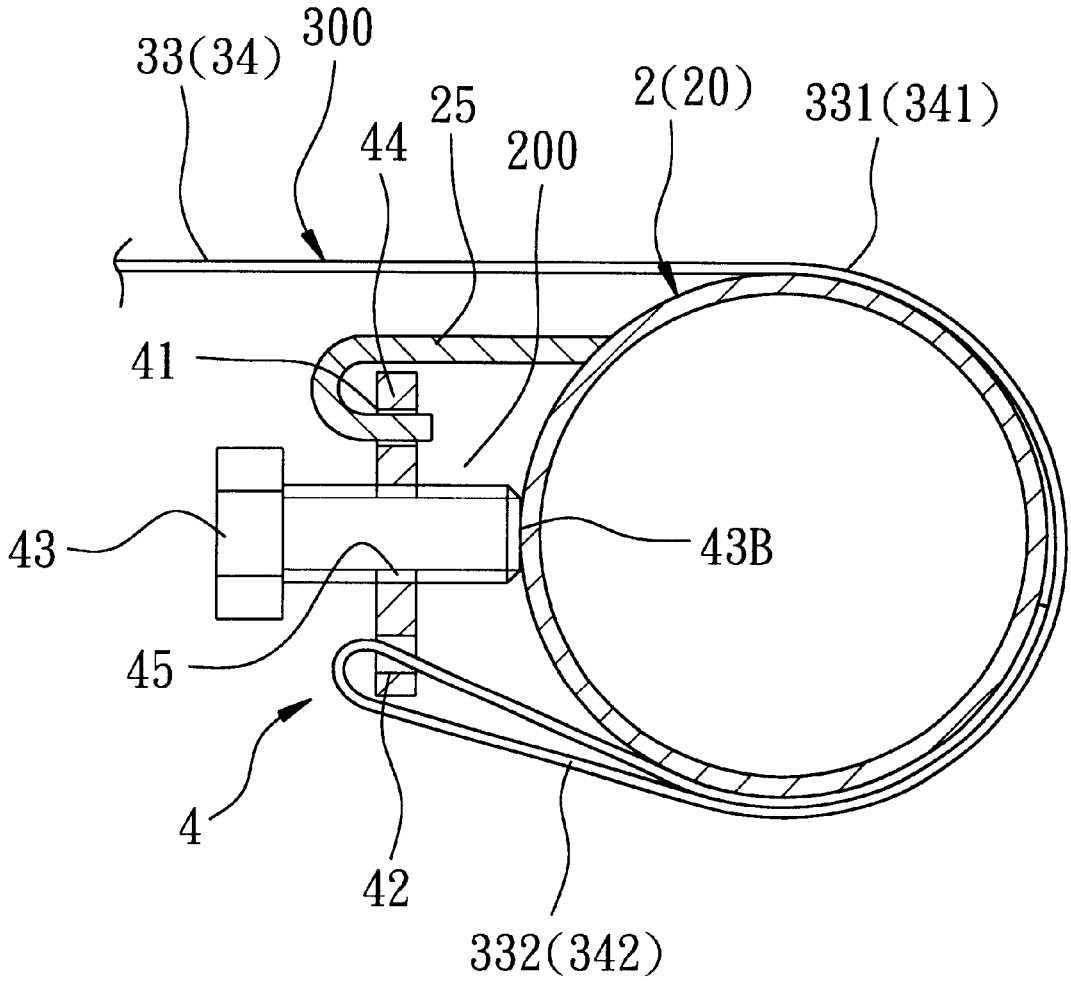
FIG. 4 is a fragmentary sectional view of the preferred embodiment taken along lines IV—IV in FIG. 3, illustrating how a net is mounted on a rectangular frame body.
Figure 5:
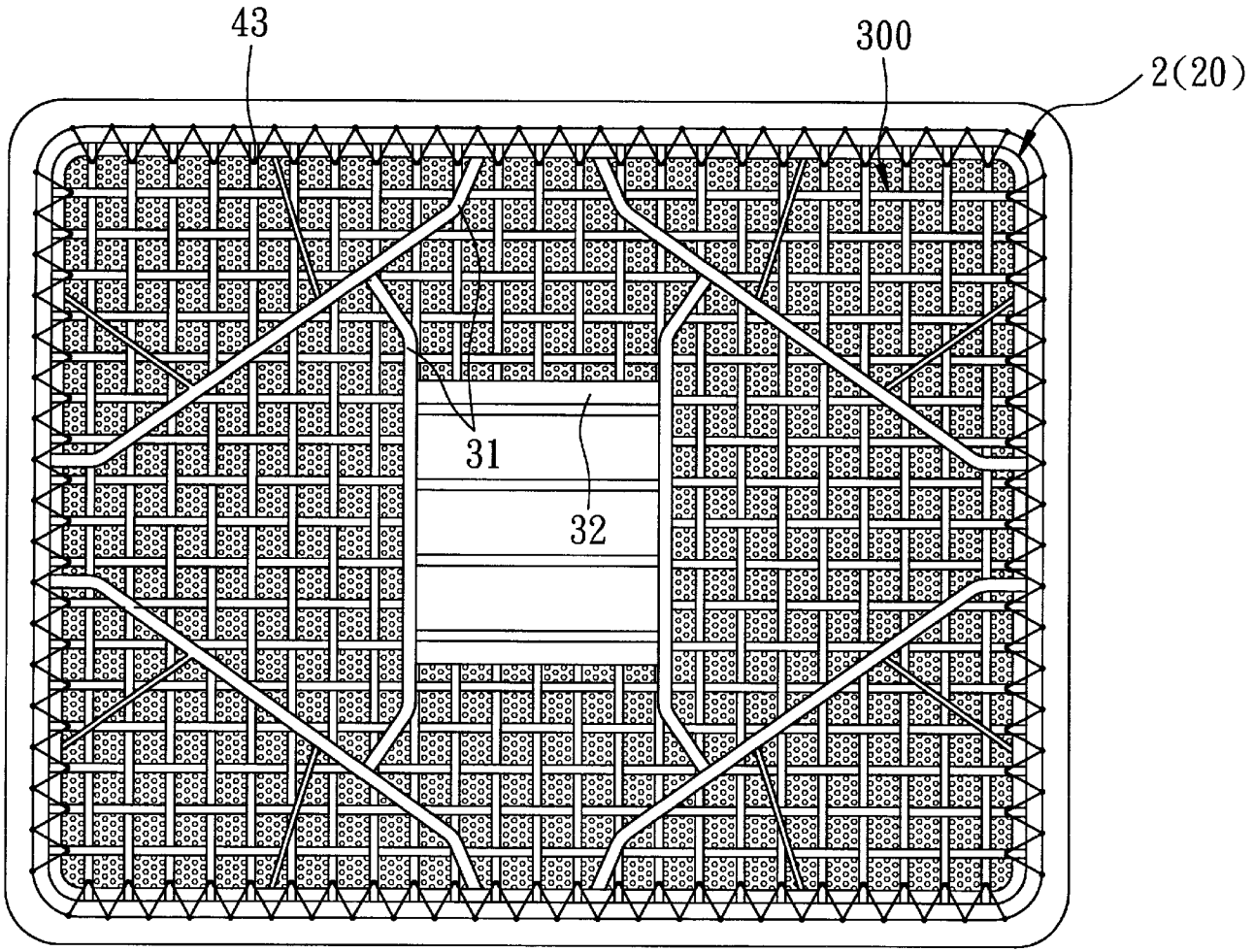
FIG. 5 is a bottom view of the preferred embodiment, illustrating how the webbed frame is strengthened by a plurality of strengthening frames.

Referring to FIGS. 3 and 4, a preferred embodiment of a webbed frame 2 according to the present invention is adapted for use in a bed, and includes a rectangular frame body 20, a plurality of first and second straps 33,34, a plurality of spaced apart retainers 25, a plurality of adjuster units 4, a mattress cover 5, a ventilated mattress 8, and a bed sheet 7.

As illustrated, the frame body 20 includes left, right, front and rear frame portions 21,22,23,24 which cooperatively define a frame space 200 therein.

The first and second straps 33,34, preferably made from metal, are mounted on the frame body 20, and extend in criss-cross manner to form a net 300 that covers the frame space 200 (see FIG. 4). Each of the first and second straps 33,34 has two opposite end sections 331,341 that are trained on and turned around the frame body 20 and that have terminating ends 332,342 disposed underneath the net 300.

The retainers 25 are uniformly spaced apart from each other, and are fixed on and along the entire length of the frame body 20 in such a manner that the retainers 25 extend into the frame space 200.

Each of the adjuster units 4 includes a connector 44 and an adjusting bolt 43. The connector 44 is mounted slidably on a respective one of the retainers 25, and is further connected to a respective one of the terminating ends 332,342 of the first and second straps 33,34 so that movement of the connector 44 on the respective one of the retainers 25 results in concurrent movement of the respective one of the terminating ends 332,342 so as to tighten or loosen the first and second straps 33,34 on the frame body 20 and so as to adjust tension of the net 300. The adjusting bolt 43 engages threadedly and extends through the connector 44, and has an abutting end 43B that abuts against the frame body 20 in such a manner that rotation of the adjusting bolt 43 results in concurrent movement of the connector 44 and the respective one of the terminating ends 332,342 so as to permit adjustment of the tension of the net 300 on the frame body 20.

Since the connector 44 and the respective one of the terminating ends 332,342 are concurrently moved in the same direction during tightening of the net 300, the disconnection drawback as encountered in the prior art can be eliminated.

Each of the retainers 25 is generally U-shaped, and has one end fixed on the frame body 20. The connector 44 is in the form of a plate having a top end formed with an upper hole 41 for extension of the other end of the retainer 25, a bottom end formed with a lower hole 42 for extension of the respective one of the terminating ends 332, 342, and a threaded hole 45 formed between the upper and lower holes 41, 42 to permit threaded extension of the adjusting bolt 43. Each of the terminating ends 332, 342 is formed into a loop that loops around the bottom end of the plate.

Preferably, a plurality of strengthening frame portions 31 which are disposed in the frame space 200 and are connected to the frame body 20 so as to enhance rigidity of the webbed frame and so as to define a cushion receiving space 32 between the net 300 and the strengthening frame portions 31. A cushion member (not visible) can be disposed in the cushion receiving space 32 so as to absorb a load applied on the net 300.

Since the specific structures of the mattress cover 5, the ventilated mattress 8 and the bed sheet 7 are not pertinent to the present invention, a detailed description of the same are omitted herein for the sake of brevity.

Figure 6:
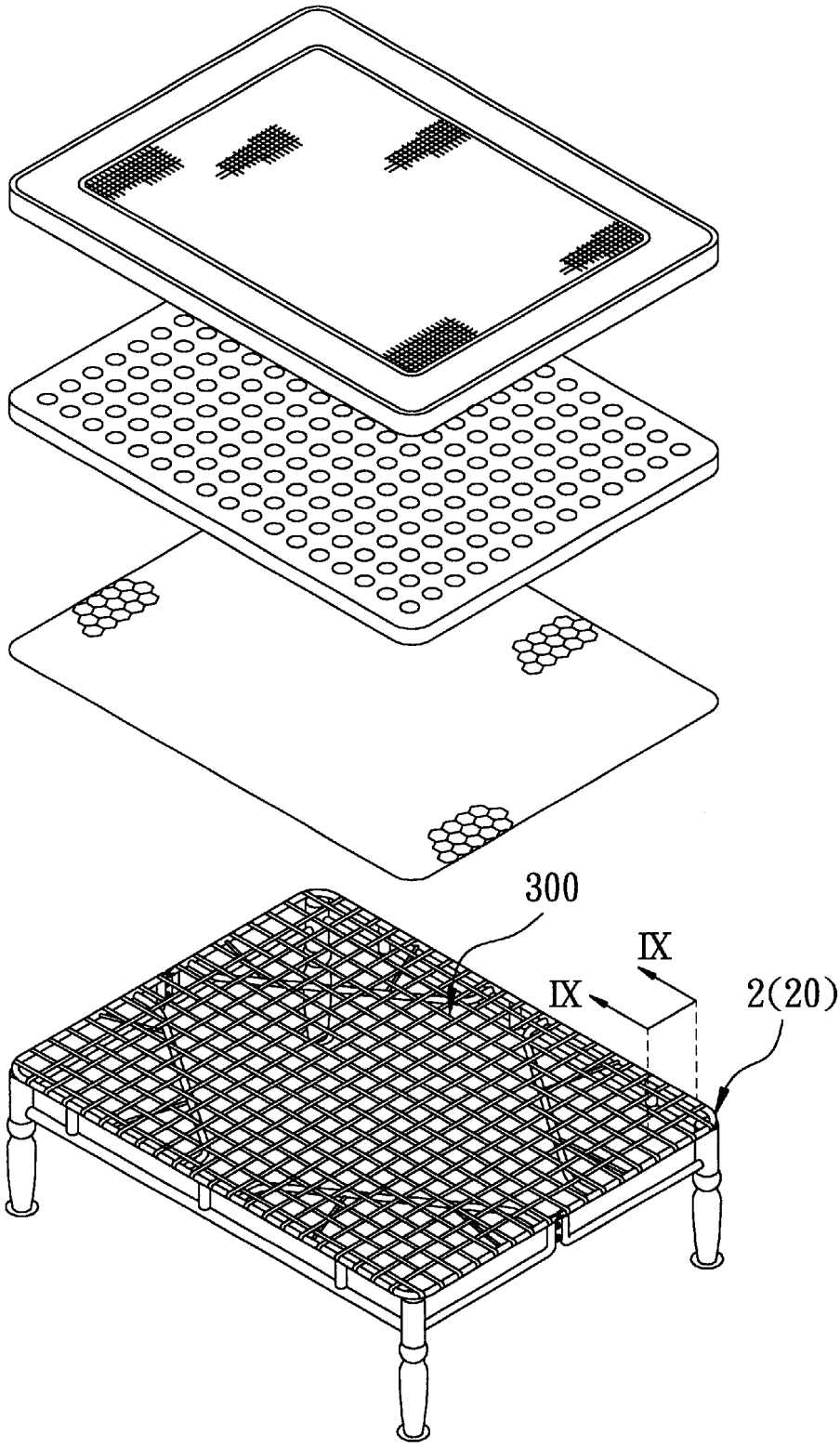
FIG. 6 is an exploded perspective view showing a modified preferred embodiment of a webbed frame according to the present invention for use in a bed.
Figure 7:
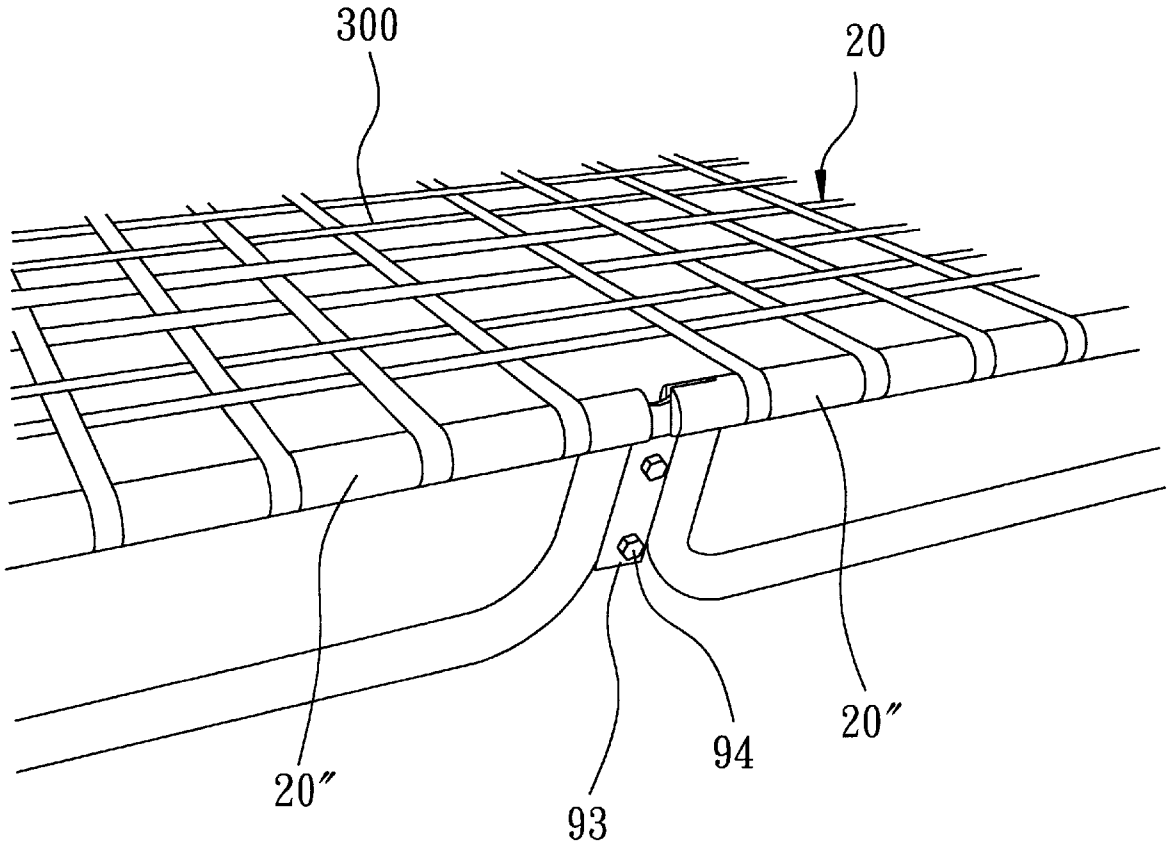
FIG. 7 is a fragmentary perspective view of the modified preferred embodiment shown in FIG. 6.
Figure 8:
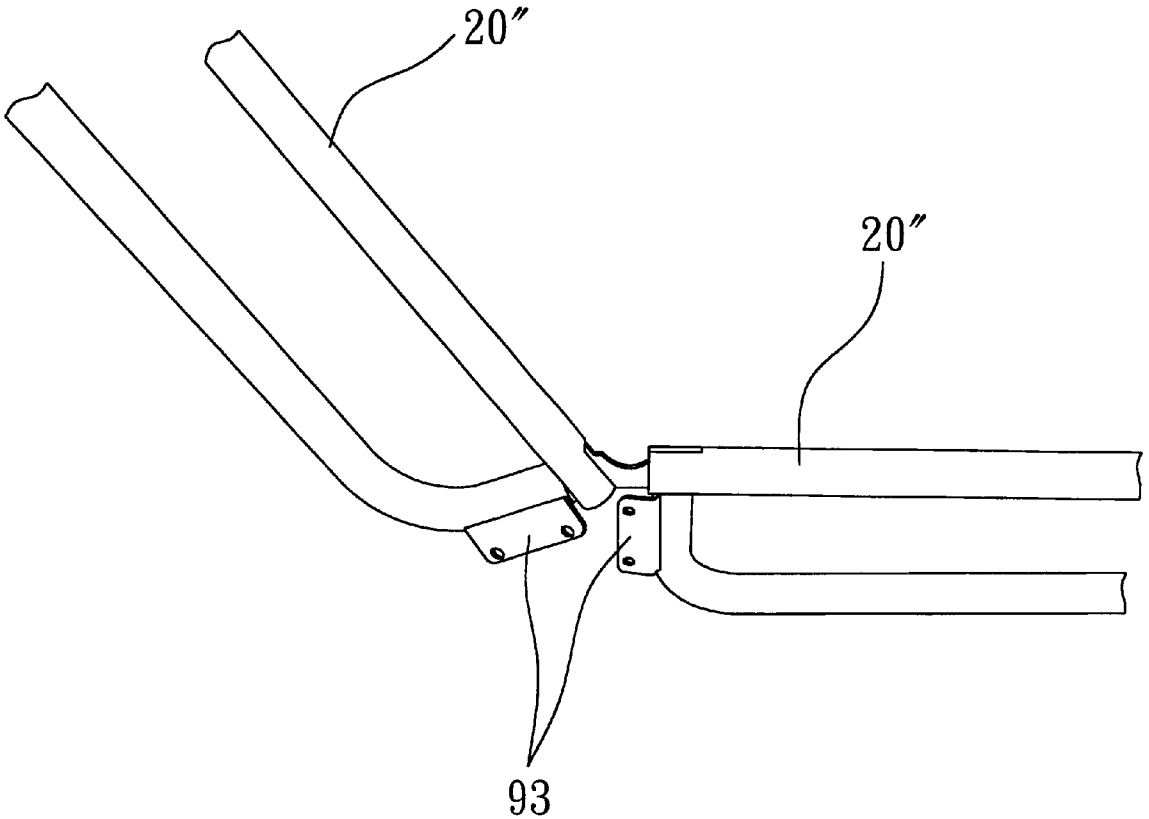
FIG. 8 is a fragmentary side view illustrating two pivotally connected frame halves of the modified preferred embodiment with straps removed therefrom.
Figure 10:
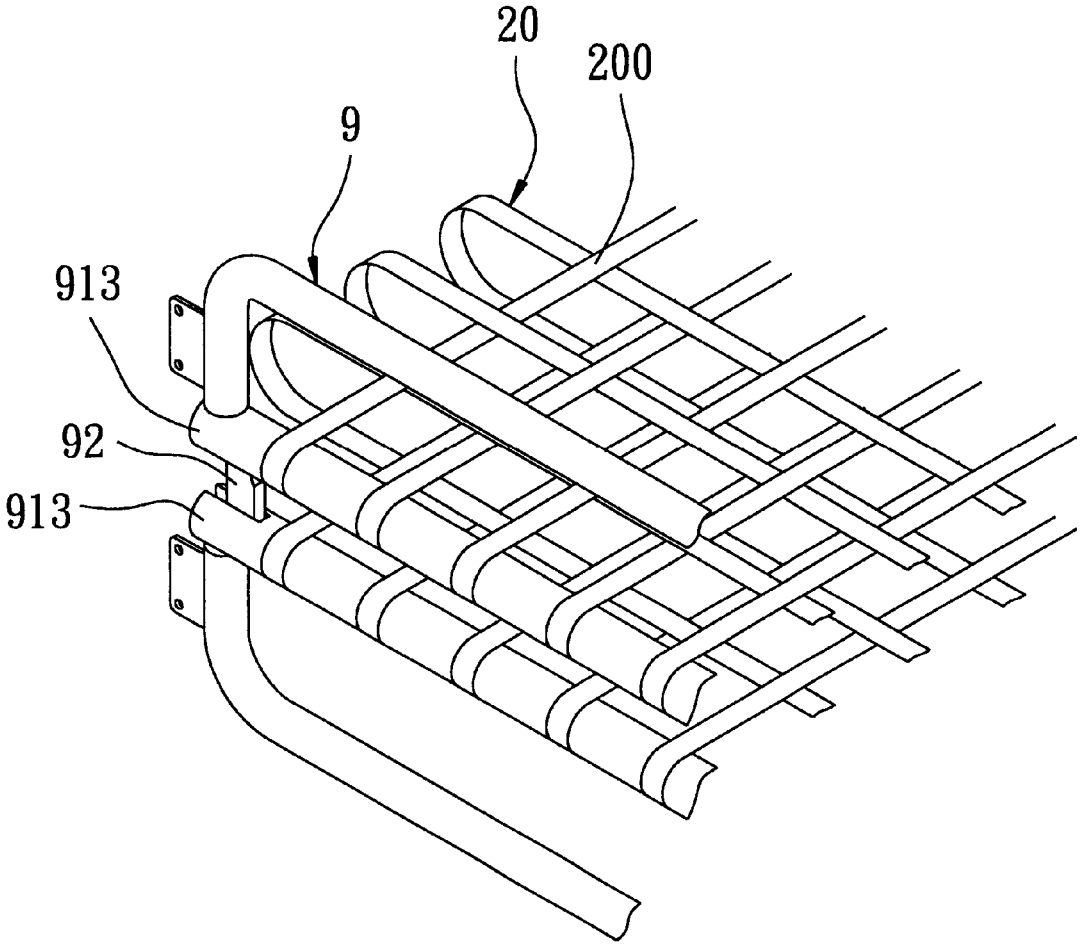
FIG. 10 is a fragmentary perspective view of the modified preferred embodiment in a stored position.

Referring to FIGS. 6, 7 and 8, a modified preferred embodiment of the present invention is shown to have a structure similar to that of the previous embodiment. The main difference resides in that the frame body 20 includes two pivotally connected frame halves 20", which are movable relative to each other between a storage position, where the frame halves 20" are stacked one above the other, as best shown in FIG. 10, and a use position, where the frame halves 20" are unfolded, as best shown in FIG. 7.

Figure 9:
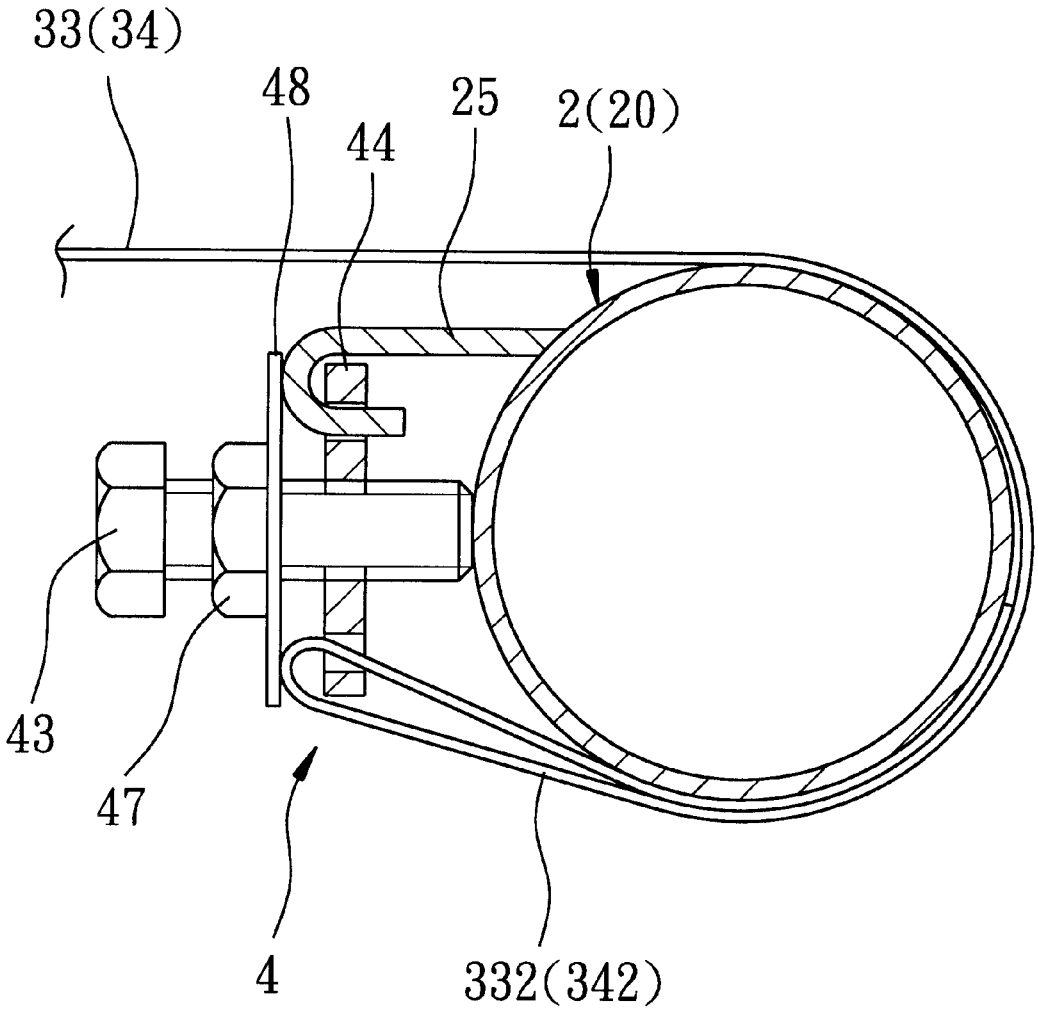
FIG. 9 is a fragmentary sectional view of the modified preferred embodiment taken along lines IX—IX of FIG. 6, illustrating how a net is mounted on the frame halves.

Referring to FIG. 9, each of the adjuster units 4 further includes a rigid washer 48 and a nut 47. The rigid washer 48 is sleeved around the adjusting bolt 43. The nut 47 is mounted threadedly on the adjusting bolt 43 in such a manner that rotation of the nut 47 in a clockwise direction on the adjusting bolt 43 results in movement of the washer 48 toward the connector 44 and permits the washer 48 and the connector 44 to cooperate with each other to clamp the respective terminating end 332,342 of the first and second straps 33,34 therebetween, thereby preventing loosening and disorder of the first and second straps 33, 34 when the frame halves 20" are folded into the storage position. The frame halves 20" are preferably provided with two connector plates 93 that overlap each other when the webbed frame of the present invention is disposed at the use position. The plates 93 can be immobilized by bolt-and-nut sets 94,as best shown in FIG. 7, so as to enhance stability of the webbed frame at the use position.

While the present invention has been described in connection with what is considered the most practical and preferred embodiments, it is understood that the present invention is not limited to the disclosed embodiments but is intended to cover various arrangements included within the spirit and scope of the broadest interpretation so as to encompass all such modifications and equivalent arrangements.

I claim:

1. A webbed frame for furniture, comprising:

a frame body defining a frame space;

a plurality of first and second straps mounted on said frame body and extending in criss-cross manner to form a net that covers said frame space, each of said first and second straps having two opposite end sections that are trained on and turned around said frame body and that have terminating ends disposed underneath said net;

a plurality of spaced apart retainers fixed on and along the length of said frame body and extending into said frame space;

a plurality of adjuster units, each of which includes a connector mounted slidably on a respective one of said retainers and connected to a respective one of said terminating ends of said first and second straps so that movement of said connector on the respective one of said retainers results in concurrent movement of said respective one of said terminating ends so as to tighten or loosen said first and second straps on said frame body and so as to adjust tension of said net, and an adjusting bolt threadedly engaging and extending through said connector and having an abutting end that abuts against said frame body so that rotation of said adjusting bolt results in concurrent movement of said connector and said respective one of said terminating ends so as to permit adjustment of the tension of said net on said frame body.

2. The webbed frame as defined in claim 1, wherein each of said retainers is generally U-shaped, and has one end fixed on said frame body.

3. The webbed frame as defined in claim 2, wherein said connector is in the form of a plate having a top end formed with an upper hole for extension of the other end of said retainer, a bottom end formed with a lower hole for extension of said respective one of said terminating ends, and a threaded hole formed between said upper and lower holes to permit threaded extension of said adjusting bolt, each of said terminating ends of said first and second straps being formed into a loop that loops around said bottom end of said plate.

4. The webbed frame as defined in claim 1, further comprising a plurality of strengthening frame portions disposed in said frame space and connected to said frame body so as to enhance rigidity of said webbed frame and so as to define a cushion receiving space between said net and said strengthening frame portions, and a cushion member disposed in said cushion receiving space so as to absorb a load applied on said net.

5. The webbed frame as defined in claim 1, wherein said frame body includes two pivotally connected frame halves, which are movable relative to each other between a storage position, where said frame halves are stacked one above the other, and a use position, where said frame halves are unfolded.

* * * * *